United States Patent [19]

Pujol

[11] 4,162,046

[45] Jul. 24, 1979

[54] HORIZONTAL-AXLE GRINDER WITH ROTATABLE SIEVE

[76] Inventor: Carlos O. Pujol, Marina Street No. 51, Badalona (Barcelona), Spain

[21] Appl. No.: 901,911

[22] Filed: May 1, 1978

Related U.S. Application Data

[63] Continuation of Ser. No. 729,299, Oct. 4, 1976, abandoned.

[30] Foreign Application Priority Data

Jul. 20, 1976 [ES] Spain ..... 449.975

[51] Int. Cl.[2] ..... B02C 23/10

[52] U.S. Cl. ..... 241/46.17; 241/70; 241/79.3

[58] Field of Search ..... 241/46.11, 46.15, 46.17, 241/70, 79.2, 79.3, 171, 172

[56] References Cited

U.S. PATENT DOCUMENTS

| | | | |
|---|---|---|---|
| 3,653,600 | 4/1972 | Schold | 241/74 |
| 3,802,633 | 4/1974 | Schold | 241/72 |
| 3,844,490 | 10/1974 | Schold et al. | 241/172 X |
| 4,044,957 | 8/1977 | Schold | 241/46.15 X |

*Primary Examiner*—Richard B. Lazarus

*Attorney, Agent, or Firm*—Blanchard, Flynn, Thiel, Boutell & Tanis

[57] ABSTRACT

A cooled horizontal-axle grinder for the predispersion of solids in liquids, which grinder incorporates a grinding chamber with a double wall for cooling, in which chamber are presented grinding bodies such as balls generally introduced by the treated product intake port and extracted by an outlet in the lower part of the chamber. The grinder is equipped with a circulating pump for the product to be treated which circulates in a continuous manner through the grinding chamber. The rotatable grinder axle carries interchangeable discs or agitator elements interspersed with spacers. The grinder includes a separating sieve designed to retain the grinding balls within the grinding chamber while permitting the finely ground product to flow therethrough to the exterior along the length of and around the axle. The sieve includes a cylinder coaxial with the axle and having slots of suitable shape to realize the aforementioned function, which cylinder is coaxially coupled to a cylindrical chamber with product outlet holes so that the sieve cylinder rotates jointly with the grinding chamber axle and, due to this, produces a displacement of the balls towards the exterior by reason of centrifugal force.

1 Claim, 3 Drawing Figures

HORIZONTAL-AXLE GRINDER WITH ROTATABLE SIEVE

This is a continuation of application Ser. No. 729,299, filed Oct. 4, 1976 now abandoned.

SUMMARY OF THE INVENTION

The present invention refers to improvements in cooled horizontal-axle grinders for the predispersion of solids in liquids.

In the invention, improvements have been conceived relating to cooled horizontal-axle grinders for the predispersion of solids in liquids of high or medium viscosity, which grinders are of the type which incorporate grinding bodies, for example balls, in the chamber, where this grinding chamber is provided with a double wall for the corresponding cooling mechanism and, in turn, with a circulating pump for the liquid coolant in question, and also incorporates an axle or shaft on which are mounted corresponding interchangeable agitator discs situated at predetermined distances from each other by means of separators, where this shaft is driven by a motor through a suitable transmission system and speed regulator; the system also contains a pump and corresponding flow regulator which impel the product being treated.

The improvements which are the object of the invention relate to an element acting as a filter, which retains the grinding bodies in the interior of the grinding chamber, while giving passage exclusively to the product as it is treated. This filter comprises a sieve mounted coaxially with and around the axle and joined to it in such a way that the sieve rotates with the axle, thereby retaining the grinding balls in the grinding chamber while permitting the finely ground product to flow through the sieve for discharge to the exterior.

With the object of simplifying the explanation, this descriptive report is accompanied by two sheets of drawings in which are represented a method of implementation which is illustrated by way of an example.

DETAILED DESCRIPTION

Figure 1:
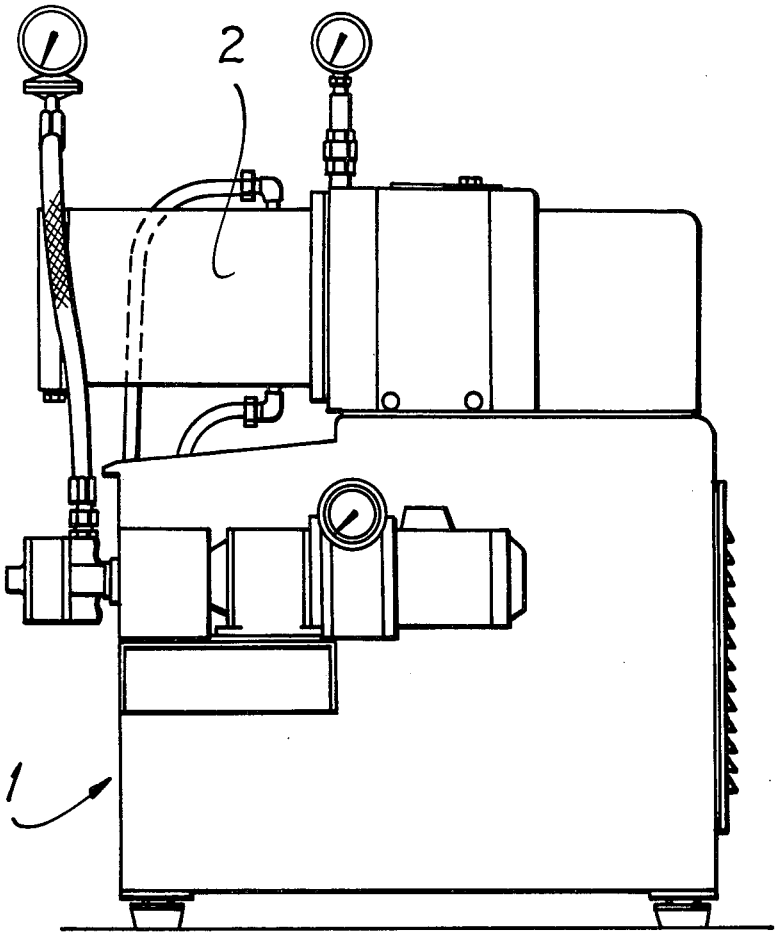
FIG. 1 shows an exterior view in lateral elevation of a grinder of known type in which there is incorporated the improvements which are the object of the invention.
Figure 2:
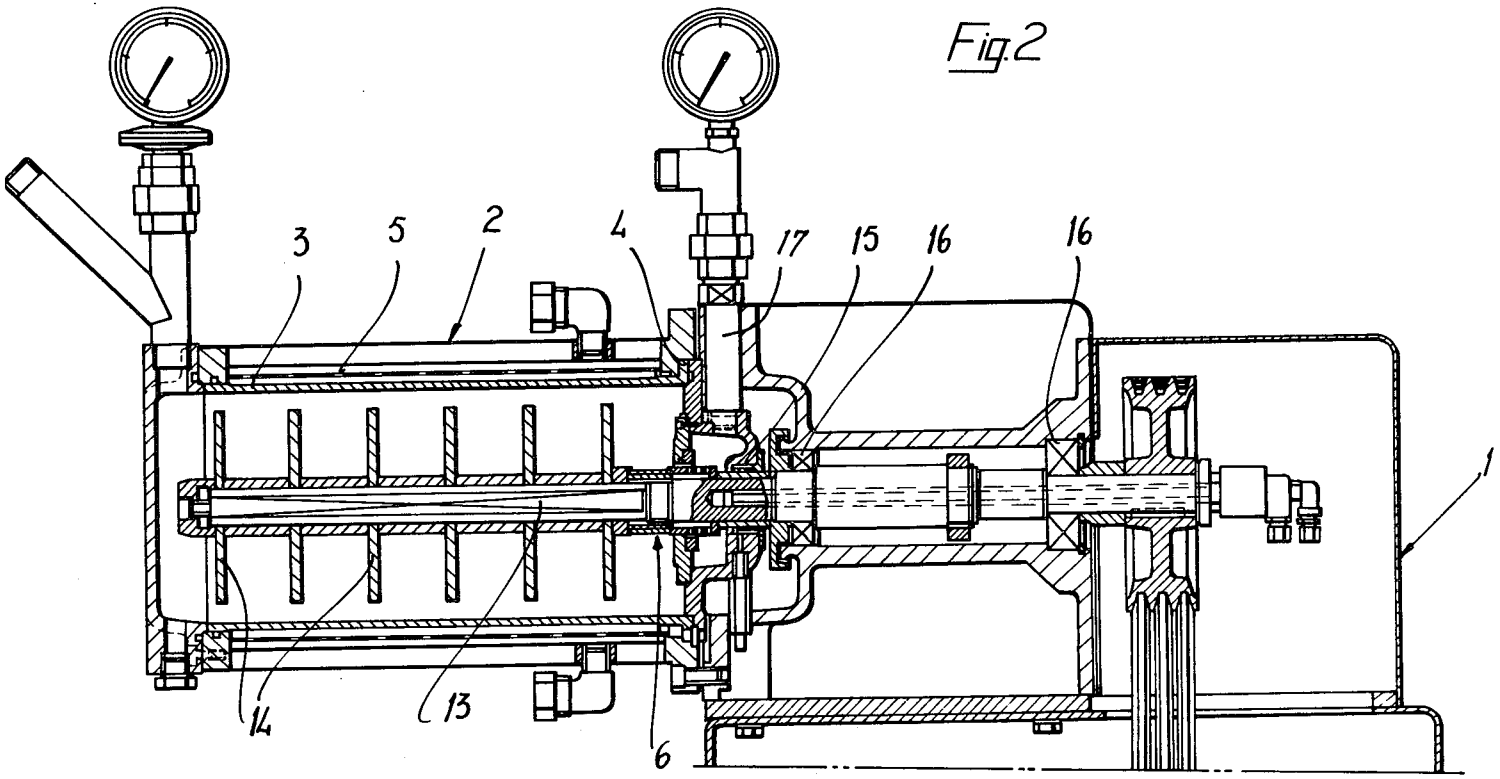
FIG. 2 corresponds to a longitudinal sectional view of the grinding chamber in which is situated the filter.

With reference to the drawings, the implementation comprises a machine 1 having a body 2 which incorporates the body proper of the horizontal axle grinder. This grinder has a jacket 3 which defines therein the grinding chamber. The jacket is mounted in an unconstrained arrangement, being fixed at one extreme 4 and free at the other, which arrangement permits the absorption of differential expansion as produced between the internal grinding chamber and the external cooling chamber 5, thereby avoiding cracks or ruptures in its body welding caused by the stresses set up by differential expansion between the component parts.

In the aforementioned grinding chamber there is provided a separating sieve 6 formed by a coaxial cylinder 7 with circular slots or openings 8 of suitable dimension for retaining the grinding bodies within the grinding chamber while permitting the finely ground product to freely flow through the sieve and in the direction of the arrows F, which product then circulates through the annular space 9 formed between the axle 13 and the cylinder 7, and then through the holes 11 in the chamber outlet cylinder 10 into the annular discharge chamber or reservoir 18 for discharge through the outlet pipe 17.

Figure 3:
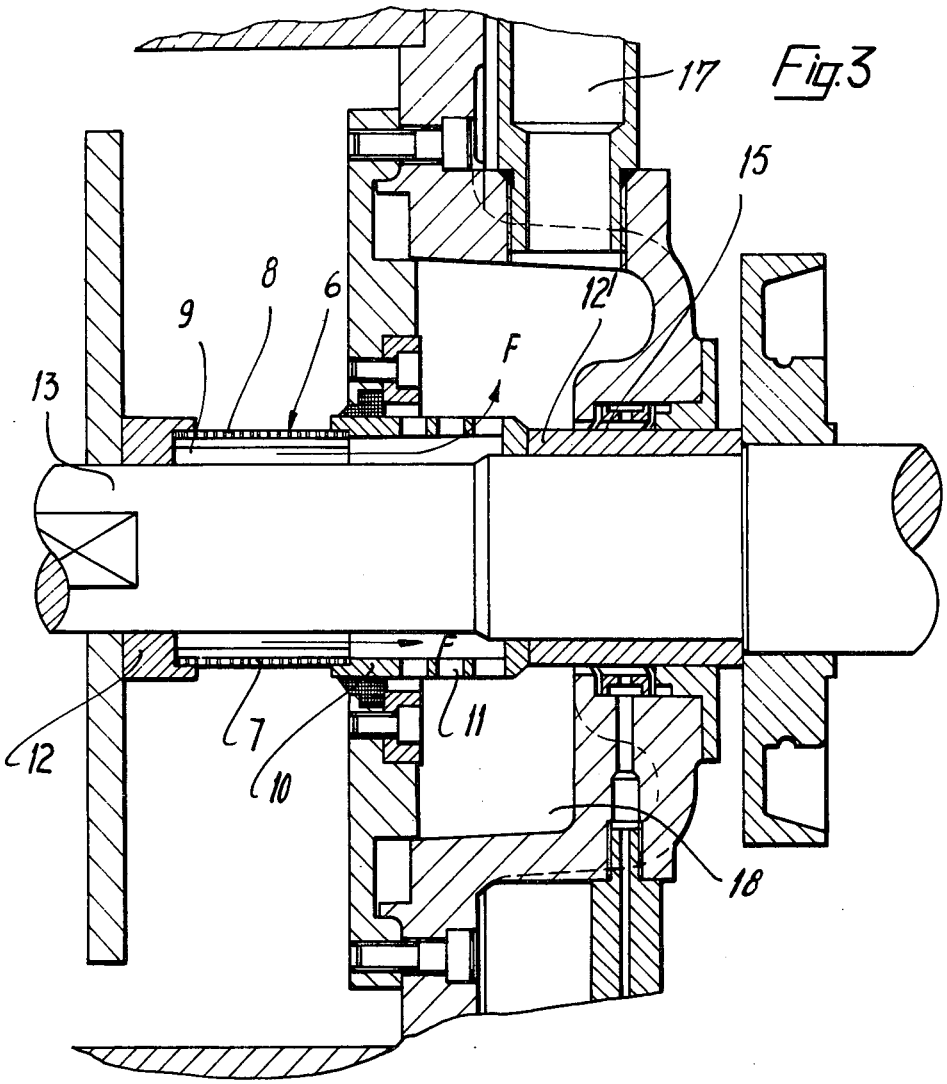
FIG. 3 shows details, in section, of the filter and its mounting.

The rotatable sieve 6 is thus formed by the cylinder 7 and supported by the cylinder 10, both elements being coupled coaxially, since there exists a support piece 12 for the cylinder 7 and another support piece 12' for the cylinder 10. Note in FIG. 3 that cylinder 10 is rotatably and sealingly supported in the end wall of the grinding chamber.

The cylinder 7 rotates jointly with the axle 13 on which there is mounted the agitator discs 14.

Due to the rotation of the cylinder 7, the balls contained in the grinding chamber are displaced preferentially towards the exterior of the grinding chamber as a result of the centrifugal force caused by the rotation of cylinder 7, whereby scarcely any abrasion is produced on the exterior of cylinder 7.

With this type of sieve there is no requirement for any type of regulation mechanism, it being self-cleaning due to its rotation.

The axle or shaft 13 incorporates a cooling system to dissipate the heat produced in parts subject to friction, such as the seal 15, axial bearings 16 etc., which cooling system is formed by a rotatable dual-passage joint connected to the axle and whose function consists in introducing and draining the liquid coolant through a plunging tube with a teflon guide at one end.

The cooling of the seal 15 is effected by means of a circuit formed by an impulse-activated membrane pump where there is a reservoir mounted on the grinder axle and liquid delivery and return tubes to the seal and reservoir respectively. On connecting up the machine, the seal cooling is automatically brought into action, in such a form as never to rotate while dry, so as to prevent damage to the seal lip caused by lack of lubrication and an excessive operating temperature.

The invention, in essence, can be implemented in other forms of realization which may differ in detail from that outlined by way of example in the above description, which forms of realization will be equally capable of achieving the type of protection sought. Thus, it may be constructed in whatever shape or form, and with whatever materials and means most suitable, while all of this remains encompassed within the spirit of the claims.

The embodiments of the invention in which an exclusive property or privilege is claimed are defined as follows:

1. In a cooled horizontal-axle grinder, such as for the predispersion of solids in liquids, which grinder includes wall means defining therein a grinding chamber, grinding bodies such as balls positioned within said grinding chamber, a rotatable agitator shaft extending horizontally through said grinding chamber and supported for rotation about a substantially horizontal axis, a plurality of agitator discs mounted on said shaft for rotation therewith, said discs being axially spaced apart along said shaft and having an endmost disc positioned adjacent but axially spaced from an end wall of said chamber to define a substantially annular region therebetween which surrounds said shaft and comprises a part of said grinding chamber, said end wall having a central opening through which passes said shaft, a sieve structure associated with said region for straining the treated product which is withdrawn from the grinding chamber, a discharge reservoir located on the opposite side of said end wall from said grinding chamber, and discharge opening means communicating with said discharge reservoir, the improvement wherein said sieve structure comprises:

a first mounting structure fixed to said shaft and disposed directly adjacent the endmost disc, a second mounting structure fixed to said shaft in axially spaced relationship to said first mounting structure, said second mounting structure being positioned in the vicinity of said end wall, an elongated thin-wall sleeve-like sieve fixedly mounted on and extending axially between said first and second mounting structures, said sieve being concentric with and spaced radially outwardly from said shaft so as to define an annular intermediate chamber therebetween which is free of obstructions, said intermediate chamber communicating with said region of the grinding chamber through said sieve, said region also being free of obstructions except for the presence of said sieve, whereby the treated product can flow from said grinding chamber radially inwardly through said region and then radially inwardly through said sieve into said intermediate chamber;

said second mounting structure including a support member fixed to the shaft and a support sleeve positioned in concentric and surrounding relationship to said shaft, said support sleeve having one end thereof fixed to said support member and the other end thereof fixedly connected to the adjacent end of said sieve, said support sleeve passing through the central opening in said end wall and being spaced radially from said shaft to define a compartment therebetween which is free of obstructions and which is in open coaxial communication with said intermediate chamber, said support sleeve being rotatably and sealingly supported on said end wall, and a plurality of radial openings formed through said support sleeve on the opposite side of said end wall from said sieve for permitting discharge of the treated product from said compartment into said discharge reservoir.

* * * * *